US006419102B1

(12) United States Patent
Harpenau

(10) Patent No.: US 6,419,102 B1
(45) Date of Patent: Jul. 16, 2002

(54) WALL OUTLET BOX FOR A DRYER VENT EXHAUST CONDUIT

(76) Inventor: Richard John Harpenau, 17369 SE. Conch Bar Ave., Tequesta, FL (US) 33469

( * ) Notice: Subject to any disclaimer, the term of this patent is extended or adjusted under 35 U.S.C. 154(b) by 0 days.

(21) Appl. No.: 09/627,691

(22) Filed: Jul. 28, 2000

Related U.S. Application Data

(60) Provisional application No. 60/180,274, filed on Feb. 4, 2000.

(51) Int. Cl.[7] ..... H02G 3/08

(52) U.S. Cl. ..... 220/3.3; 220/3.2; 220/3.5; 137/360

(58) Field of Search ..... 220/3.3, 3.2, 3.5; 137/477, 360

(56) References Cited

U.S. PATENT DOCUMENTS 3,495,276 A * 2/1970 Suess ..... 220/3.3 X
3,847,175 A * 11/1974 Anderson ..... 137/360
4,673,097 A * 6/1987 Schuldt ..... 220/3.5
4,742,585 A * 5/1988 Logsdon ..... 220/3.3 X
5,121,948 A * 6/1992 Anderson et al. ..... 285/168
5,191,171 A * 3/1993 Bordwell ..... 220/3.2 X
5,287,665 A * 2/1994 Rath, Jr. ..... 220/3.3 X

* cited by examiner

*Primary Examiner*—Steven Pollard
(74) *Attorney, Agent, or Firm*—Akerman Senterfitt

(57) ABSTRACT

A wall outlet box for a dryer exhaust conduit. The box includes a plurality of substantially planar integral walls defining an enclosure open at the front thereof. The enclosure includes a back surface, a pair of opposing side surfaces, a top surface, and a bottom surface. The opposing side surfaces, back surface and top surface include forward facing edges collectively defining a front periphery. The front periphery preferably has a perimeter greater than the perimeter of the back surface. The bottom surface preferably extends downwardly from the back surface to the front periphery. The wall outlet box further includes at least one port in the enclosure adapted to engage with a dryer exhaust conduit. A mounting lip, which can include mounting structures, extends outwardly from the forward facing edges. The mounting lip can be configured in an L-shape to provide a shoulder which abuts the edges of a wall surface. The wall outlet box can include at least one additional port in the enclosure adapted to receive a gas line.

22 Claims, 8 Drawing Sheets

WALL OUTLET BOX FOR A DRYER VENT EXHAUST CONDUIT

CROSS-REFERENCE TO RELATED APPLICATIONS

This application claims the benefit of U.S. Provisional Patent Application No. 60/180,274, filed Feb. 4, 2000.

STATEMENT REGARDING FEDERALLY SPONSORED RESEARCH AND DEVELOPMENT (Not Applicable)

BACKGROUND OF THE INVENTION

1. Field of the Invention

The present invention relates to clothes dryer exhaust vent systems, and more particularly to a wall outlet box for a dryer vent exhaust conduit.

2. Description of the Related Art

A clothes dryer requires an exhaust conduit, typically enclosed in a wall cavity, which conveys heated air and lint from the dryer to an external location. The dryer can include a flexible hose which connects the dryer blower to the exhaust conduit. If the flexible hose is kinked or crushed, or otherwise altered or damaged, air flow from the dryer can be restricted, resulting in inefficient operation of the dryer. Of even greater concern is the possibility of lint buildup within an altered or damaged hose. Lint material is combustible, and the heat build-up due to the blocked air flow can result in fire. In this regard, the U.S. Consumer Product Safety Commissioner estimates that there are 15,500 occurrences of dryer fires annually, many of which are the result of lint trapped in the exhaust duct.

In a common installation configuration, the exhaust conduit within the wall cavity is angled so that it protrudes perpendicularly from the wall surface, and the flexible hose leading from the dryer blower is inserted therein. The diameter of the flexible hose is typically sized to allow for close engagement with the exhaust conduit.

The positioning of the exhaust conduit in the wall usually causes the flexible hose to bend in at least two places when connected. During installation, this connection is initially made and the dryer is then pushed toward the wall. Dryers are usually installed in a limited amount of space, and it can be extremely difficult to adjust the vent connection after the dryer is installed. To avoid damaging or altering the hose during installation, the dryer is often positioned a considerable distance from the wall containing the exhaust conduit.

The point of connection for the flexible hose usually consists only of the protruding metal conduit. In the prior art, one alternative to this arrangement is seen in Harpenau, U.S. Pat. No. 5,476,183, who discloses a recessed rectangular box to be mounted in a wall which can receive the coiled flexible hose, thereby allowing the dryer to be placed in close proximity to the wall. The box includes a plurality of apertures to receive the exhaust conduit so as to allow for different installation configurations. An inherent limitation of this design is that it is difficult to position the flexible hose within the box in such a way that optimal efficiency and safety are achieved. It would be advantageous to provide a wall outlet box for the exhaust conduit which can house the flexible hose, and is also configured to guide the flexible hose into the proper position during installation.

SUMMARY OF THE INVENTION

The present invention relates to a wall outlet box for a dryer exhaust conduit. The box includes a plurality of substantially planar integral walls defining an enclosure open at the front thereof. The enclosure includes a back surface, a pair of opposing side surfaces, a top surface, and a bottom surface. The opposing side surfaces, back surface and top surface include forward facing edges aligned in a single plane collectively defining a front periphery. The front periphery preferably has a perimeter greater than the perimeter of the back surface. The bottom surface preferably extends downwardly from the back surface to the front periphery. The bottom surface can extend downwardly from the back surface to the front periphery.

The wall outlet box further includes at least one port located in at least one of the back surface, opposing side surfaces, top surface, and bottom surface adapted to engage with a dryer exhaust conduit, whereby a flexible hose can be inserted into the exhaust conduit, and at least a portion of the flexible hose can be housed in the enclosure. The port can be an aperture. A mounting lip, which can include mounting structures, extends outwardly from the forward facing edges. The mounting structures can include holes in the mounting lip adjacent to the opposing side surfaces adapted to received mounting screws. The mounting lip can be configured to allow the wall outlet box to be mounted between two vertical wall studs in a wall. The top surface and opposing side surfaces can flare outwardly from the back surface to the front periphery.

The wall outlet box can also include a shoulder extending generally perpendicularly outwardly from the mounting lip proximal to the opposing side surfaces and the top surface. The shoulder preferably has a depth at least as large as the depth of a wall surface to be installed on a stud wall such that the wall outlet box can be installed in an unfinished stud wall prior to the installation of a wall surface on the stud wall, and wherein the shoulder abuts the inner edges of the wall surface after the wall outlet box is installed.

The wall outlet box can further include a generally L-shaped mounting lip adjacent to the forward facing edges of the opposing side surfaces and the top surface. The mounting lip can be integrally formed with the front periphery. The L-shaped mounting lip can include a first section which is generally perpendicular to the plane defined by the front periphery and extends rearwardly therefrom, and a second section parallel to the plane defined by the front periphery and extending outwardly therefrom. The second section can further include mounting structures adapted to secure the second section to at least one vertical stud of a stud wall. The first section preferably has a width at least as large as a wall surface to be be installed on the stud wall, whereby the first section can be secured to the stud wall, and the finished wall surface mounted on the stud wall is shouldered by the second section.

The wall outlet box can further include a substantially vertical rim portion adjacent to the front edge of the bottom surface, the rim portion adapted to extend downwardly to be in alignment with a floor surface after the wall outlet box is installed.

The wall outlet box can include at least one additional port in the enclosure adapted to receive a gas line. The enclosure can include a knockout portion located and sized to create a port when the knockout portion is removed. The knockout portion preferably initially forms an impervious integral part of the enclosure, and can be attached to the enclosure by a plurality of frangible connector webs. The knock out portion can be removed from the wall outlet box by rupturing the frangible connector webs.

In an alternative embodiment, the wall outlet box can be adapted to be installed into a finished wall. The wall outlet box can include a plurality of substantially planar integral walls defining an enclosure open at the front thereof. The enclosure can include a back surface, a pair of opposing side surfaces, a top surface, and a bottom surface. The opposing side surfaces, back surface and top surface include forward facing edges aligned in a single plane collectively defining a front periphery. The front periphery preferably has a perimeter greater than the perimeter of the back surface. The bottom surface preferably extends downwardly from the back surface to the front periphery. The bottom surface can extend downwardly from the back surface to the front periphery. The wall outlet box can include a substantially planar mounting lip adapted for placement on the exterior surface of a finished wall. The mounting lip is contiguous to the forward facing edges and extends outwardly in the plane defined by said front periphery. The mounting lip can include mounting structures.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1A:
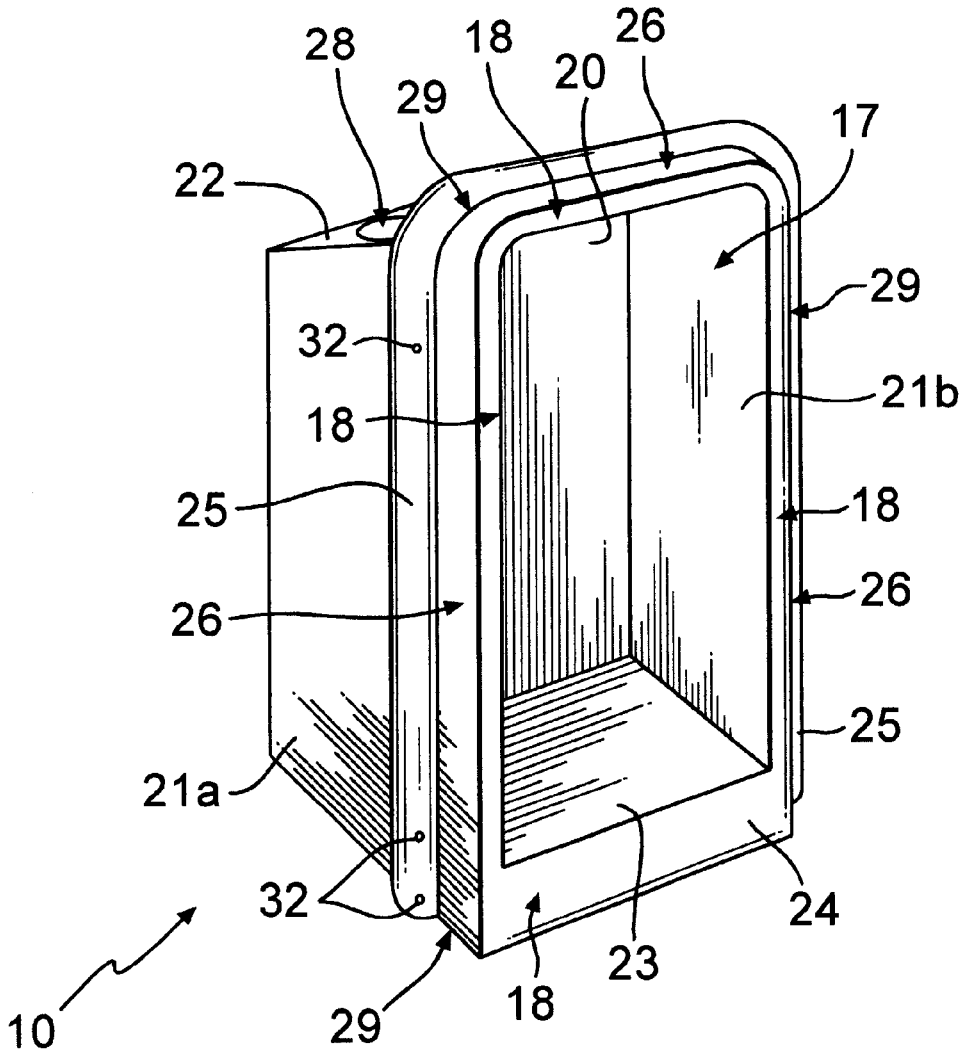
FIG. 1*a* is a perspective view of a preferred embodiment of the invention.
Figure 1C:
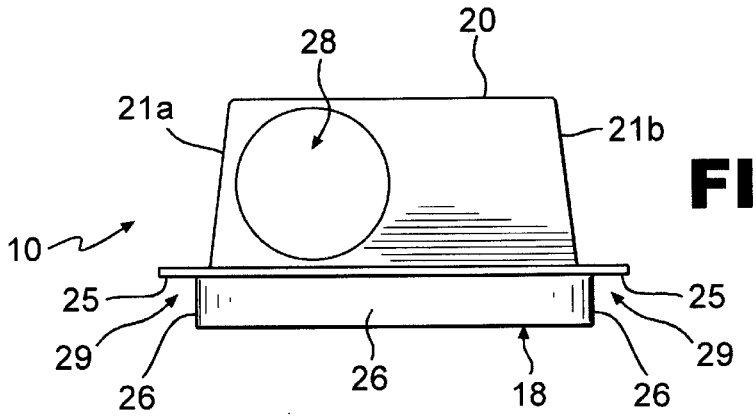
FIG. 1*c* is a top plan view of the embodiment shown in FIG. 1*a*.
Figure 1B:
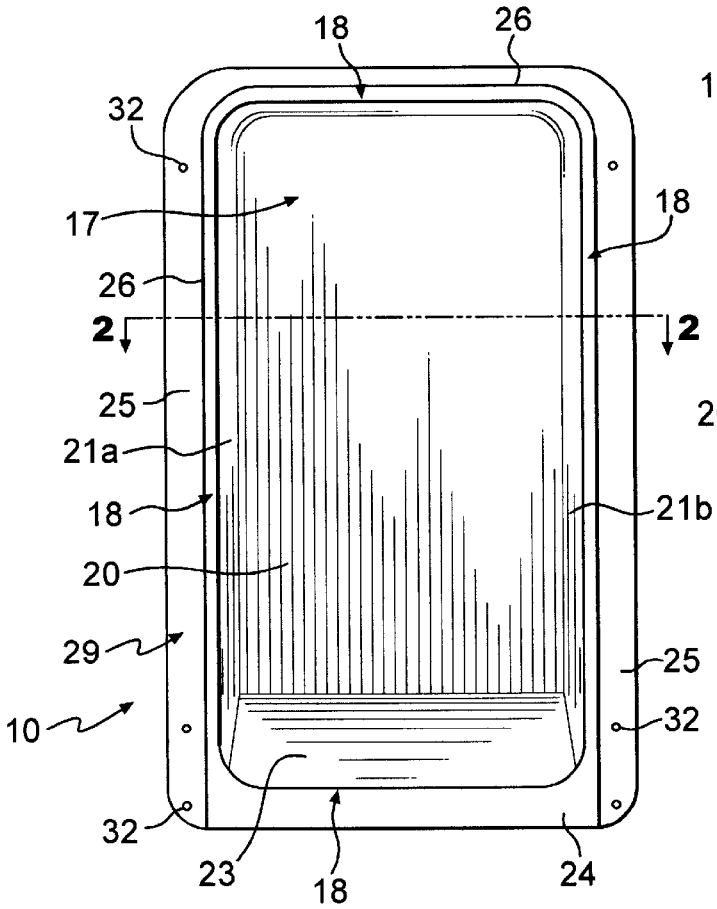
FIG. 1*b* is a front elevation view of the embodiment shown in FIG. 1*a*.
Figure 1D:
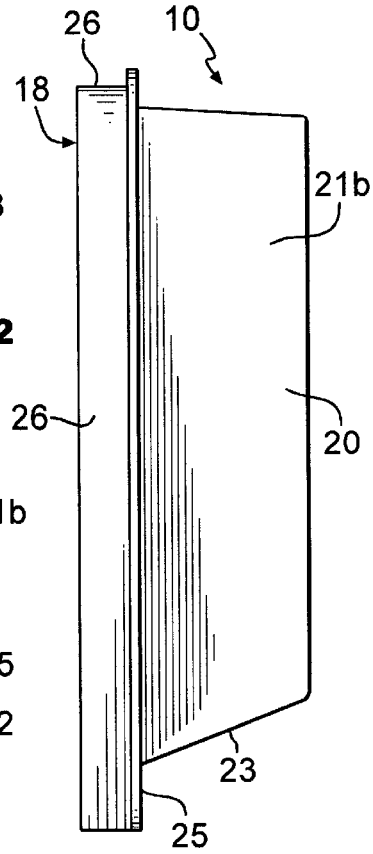
FIG. 1*d* is a side elevation view of the embodiment shown in FIG. 1*a*.

A wall outlet box 10 for a dryer exhaust vent conduit according to a preferred embodiment is illustration in FIGS. 1*a–d*. The wall outlet box 10 includes a plurality of substantially planar integral surfaces defining a pan-shaped enclosure 17. The enclosure 17 preferably includes a back surface 20, a top surface 22, opposing side surfaces 21*a* and 21*b*, and an inclined lower surface 23. The forward facing edges of back surface 20, top surface 22, opposing left and right side surfaces 21*a* and 21*b*, and inclined lower surface 23 are preferably located in the same plane and collectively define a front periphery 18. The front periphery 18 preferably has a perimeter greater than the perimeter of the back surface 20. In an installed configuration (to be described hereinafter), the front periphery 18 and the back surface 20 are preferably aligned substantially parallel to a wall surface. The inclined lower surface 23 is preferably adjacent to the back surface 20 and preferably extends downwardly from the back surface 20 to the front periphery 18 at an angle preferably between approximately 30° to 60° relative to the back surface 20.

An exhaust conduit would typically be located within a wall cavity proximate to the location where a clothing dryer would be installed. The enclosure 17 preferably includes a port adapted to engage with an exhaust conduit. The port can be an aperture, a pipe, a flexible sleeve, a flange, or any suitable structure which can engage with the exhaust conduit and allow the connection of the flexible hose to the exhaust conduit. The port can be located in any suitable portion of the wall outlet box, including the back surface 20, the top surface 22, the opposing side surfaces 21*a* and 21*b*, or inclined lower surface 23. In the illustrated embodiment, the port is an aperture 28 which extends through the top surface 22. Although a circular aperture 28 is illustrated, the aperture 28 can have any suitable configuration, such as a triangular or hexagonal configuration.

As the exhaust conduit would typically be secured to a stud wall, the aperture 28 for the illustrated embodiment is preferably offset toward the left or right side of the top surface 22 so that it can be aligned with a vertically depending exhaust conduit. In order to allow other installment configurations, the aperture 28 can be located in the back surface 20, the top surface 22, the opposing side surfaces 21*a* and 21*b*, or the bottom surface 23.

Rather than having a single aperture 28, the wall outlet box 10 can include a plurality of apertures 28 to accommodate different installation configurations. The apertures 28 can be initially sealed with a knockout portion having frangible connector webs which can be ruptured to open the desired aperture 28.

In the practice of the present invention, a variety of installation configurations can be implemented to connect a flexible hose to an exhaust conduit in a wall cavity. In the configuration illustrated herein, the dryer exhaust conduit is positioned to extend downwardly into the enclosure 17 at the time of installation. A flexible hose can then be inserted directly into the exhaust conduit. In another configuration, the exhaust conduit can be positioned above and aligned with aperture 28, and the flexible hose can then be inserted into the aperture 28 to engage with the exhaust conduit. The aperture 28 can also be adapted to receive an adaptor piece which can engage with one or both of the exhaust conduit or the flexible hose.

The wall outlet box 10 preferably includes an integrally formed mounting lip 25 which can be located in a plane substantially parallel to the plane defined by front periphery 18. The mounting lip 25 can include mounting structures, such as holes 32, which can secure the wall outlet box 10 to a wall. In a preferred embodiment, the wall outlet box 10 is attached to at least one wall stud in a stud wall.

The top surface 22 and the left and right opposing side surfaces 21*a* and 21*b* can flare outwardly from the back surface 20 to the front periphery 18. Thus, the wall outlet box 10 can have a substantially tapered shape. This tapered shape advantageously allows stacking of multiple units of the wall outlet box 10, thereby providing an efficient and space-saving means of storing and shipping one or more wall outlet boxes 10.

The wall outlet box 10 preferably includes a shoulder 26 extending generally outwardly from the front periphery 18. The shoulder 26 is preferably adjacent and contiguous to the top surface 22 and the opposing side surfaces 21*a* and 21*b*. The shoulder 26 preferably has a width equal to or greater than the depth of the wall to which the wall outlet box 10 will be attached. In a preferred embodiment, the shoulder 26 preferably extends outwardly a sufficient distance so as to be substantially in alignment with the surface of the baseboard of a finished wall surface. It is understood, however, that the invention is not limited in this regard. After a wall surface is attached to a stud wall, such as a dry wall surface, the shoulder 26 can abut the edges of the wall surface.

The wall outlet box 10 preferably includes a front base rim portion 24 which is adjacent and contiguous to the bottom surface 23 and the shoulder 26. The front base portion 24 can extend substantially vertically downward from the front periphery 18. When the wall outlet box 10 is installed in a stud wall, the bottom surface 23 preferably rests on the bottom plate of the stud wall. The vertical height of the front base rim 24 is preferably approximately equal to the vertical height of bottom plate of the stud wall so the front base rim 24 extends to the floor surface. In the installed configuration, the baseboards of the finished wall surface preferably abut the front base rim 24. The front base rim 24 is preferably in flush alignment with the front surface of the baseboards to provide a continuous planar surface. The above-described configuration of the front base rim 24 advantageously eliminates the need to notch out the upper portion of the baseboard when the wall outlet box 10 is installed into a wall.

Figure 2:
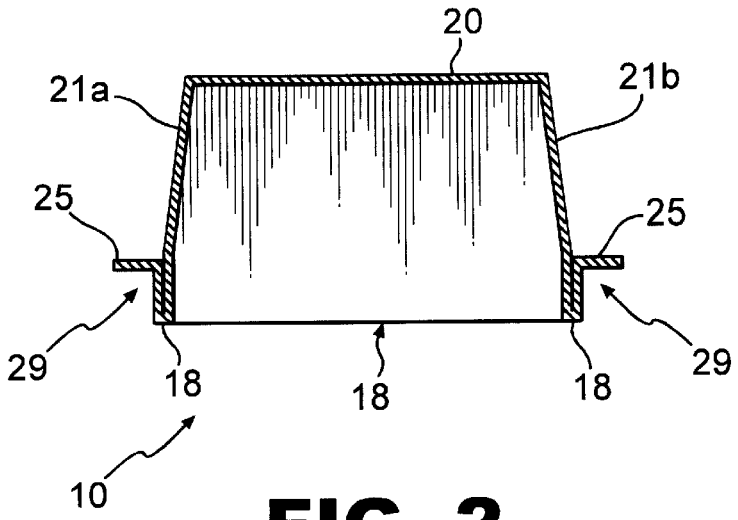
FIG. 2 is a cross-sectional view of the embodiment shown in FIGS. 1 *a–d* taken along the line 2—2 in FIG. 1*b*.
Figure 8A:
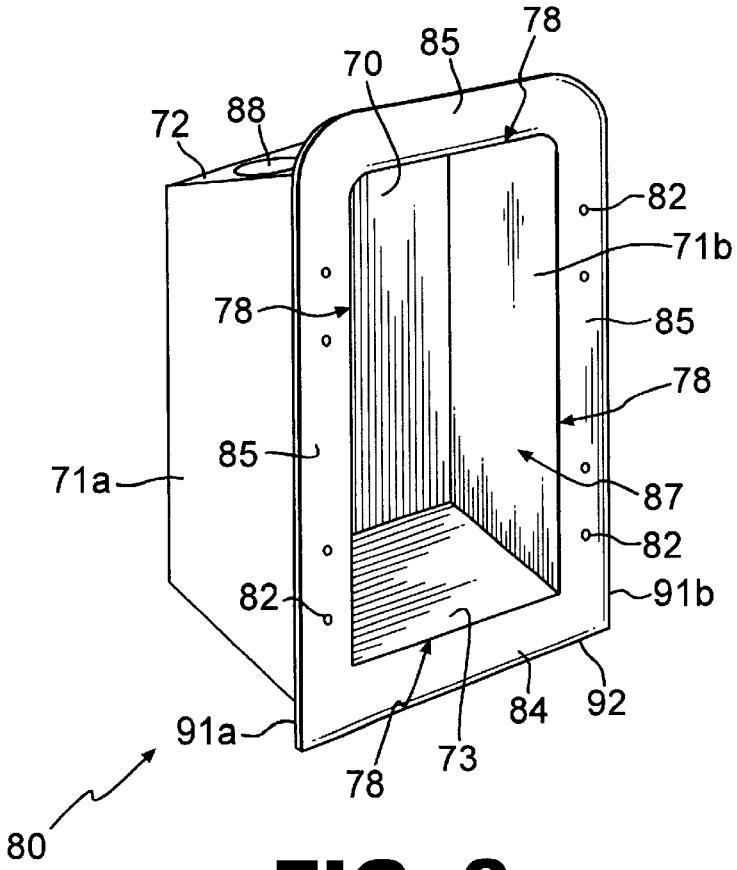
FIG. 8*a* is a perspective view of an alternative embodiment of the invention.

In a preferred embodiment, the above-described arrangement and function of the mounting lip 25 and shoulder 26 are provided by an L-shaped bracket 29. The configuration of L-shaped bracket 29 can be seen most clearly in the cross-sectional view shown in FIG. 2. The L-shaped bracket 29 can be adjacent to and integrally formed with the top surface 22 and the opposing side surfaces 21*a* and 21*b*. The L-shaped bracket 29 can have a first section that is generally perpendicular to the plane defined by the front periphery 18 and extends toward the rear surface 20, and a second section that is preferably parallel to the plane defined by the front periphery 18 and extends outwardly from the enclosure 17.

As previously indicated, the depth of the wall outlet box 10, as represented by the distance between the back surface 20 and the mounting lip 25, should preferably not exceed the depth of a stud in the wall in which the wall outlet box 10 is to be installed. The depth of wall outlet box 10 is preferably approximately equal to the depth of the wall stud so as to maximize the size of the enclosure 17. Such an arrangement allows adequate storage area for a flexible hose. The width of the wall outlet box 10 between opposing side surfaces 21*a* and 21*b* is preferably sufficient to accommodate an exhaust conduit of any size, including those which are between three and six inches in diameter.

The wall outlet box 10 is preferably dimensioned to allow installation between studs in a stud wall. In a typical stud wall, the distance between studs is approximately 14.5 or approximately 22.5 inches, but greater or lesser widths are also acceptable in conjunction with the present invention. In practice, the distance between the studs in a stud wall can be adjusted at the time of construction to accommodate the installation of wall outlet box 10.

Figure 3:
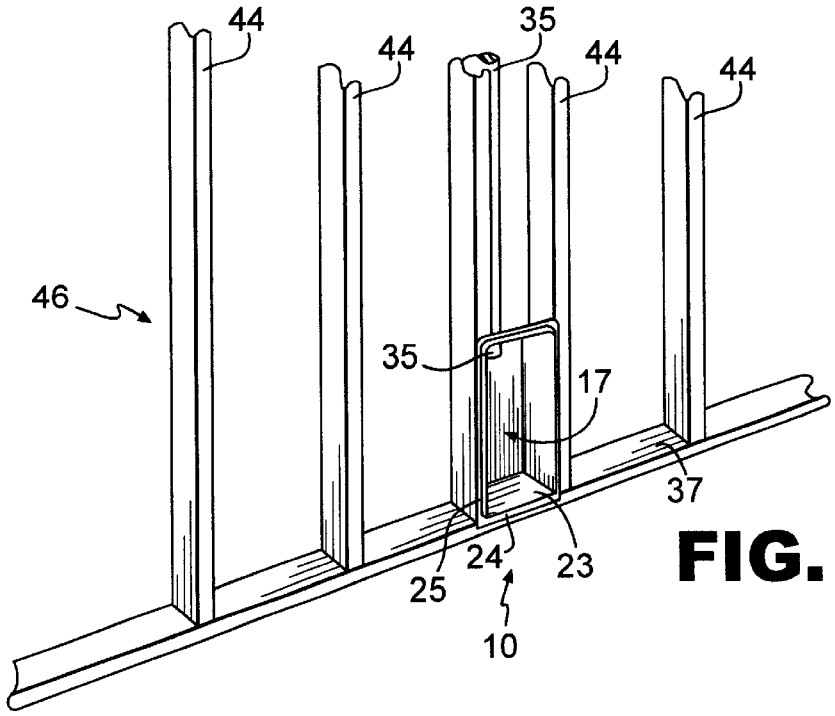
FIG. 3 is a perspective view of the embodiment shown in FIG. 1*a* installed in a stud wall.

FIG. 3 illustrates the wall outlet box 10 installed in a stud wall 46 prior to the 20 installation of a finished wall surface. The wall outlet box 10 can be secured between two substantially adjacent and vertical wall studs 44. The wall outlet box 10 is preferably attached by aligning the mounting lip 25 with the forward facing surfaces of the wall studs 44, and secured using mounting screws inserted into the holes 32. The exhaust conduit can extend through the aperture 28 (not shown) and into the enclosure 17. The forward edge of bottom surface 23 preferably rests on the top surface of the bottom plate 37 of the stud wall 46. The front base rim label 24 in FIG. 3 is preferably aligned with the front surface of the bottom plate 37. In the installed configuration, the front base rim 24 is preferably parallel to the underlying floor surface, and is most preferably approximately flush with the underlying floor surface.

Figure 4:
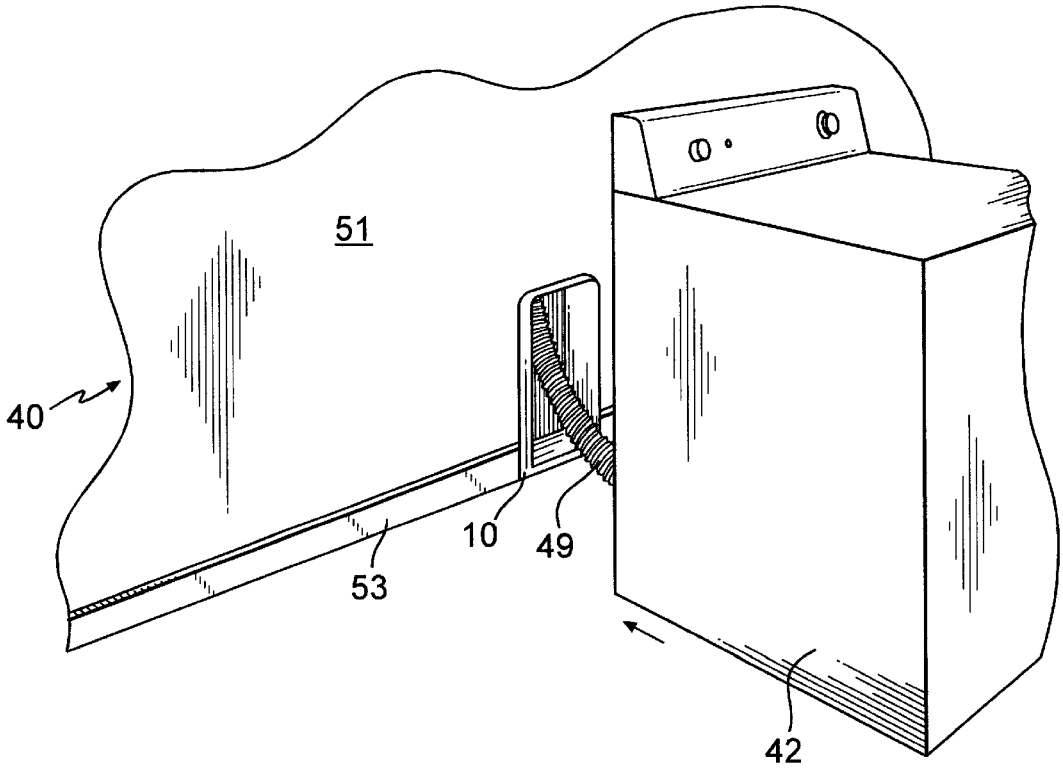
FIG. 4 is a perspective view of the embodiment shown in FIG. 1*a* installed in a finished wall, with a flexible hose partially installed therein.
Figure 5:
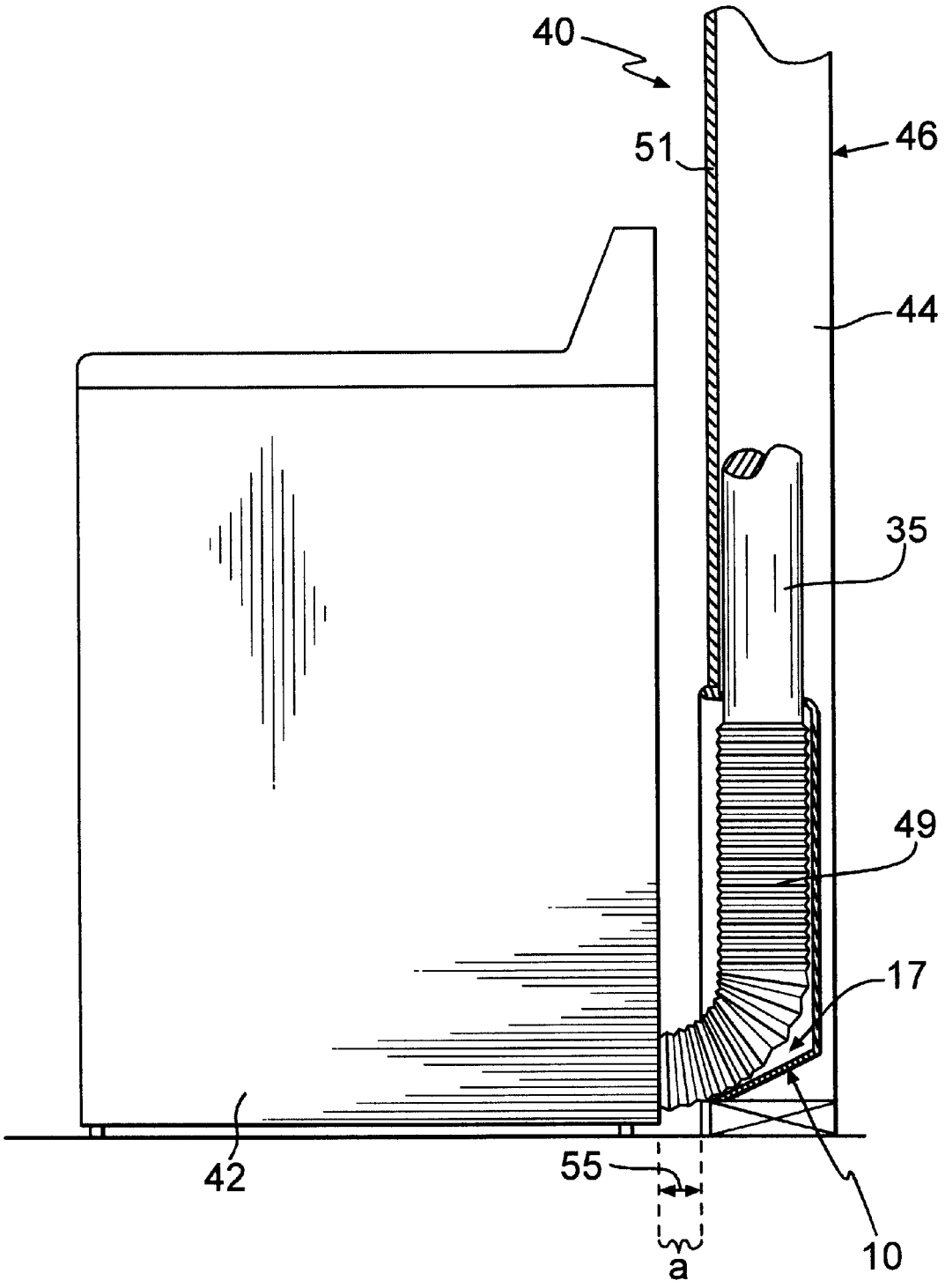
FIG. 5 is a partial cross-sectional view of a preferred embodiment of the invention in an installed configuration.

In FIG. 4, a finished wall 40 includes a wall surface 51 (for example, drywall) and a baseboard 53 which have been installed on the stud wall 46. The edges of the wall surface 51 and baseboard 53 can be substantially adjacent to the wall outlet box 10 and configured to flushly align with the shoulder 26. FIG. 4 further illustrates a dryer 42 having a flexible dryer hose 49 in a partially installed configuration. During installation, the dryer hose 49 can be inserted into the dryer exhaust conduit 35, after which the dryer 42 can be moved toward the wall outlet box 10. As shown in FIG. 5, the inclined angle of the bottom surface 23 can serve to guide the dryer hose 49 upwardly into the dryer exhaust conduit 35 when the dryer 42 is pushed towards the wall. The wall outlet box 10 can thus advantageously guide the dryer hose 49 into the dryer exhaust conduit 35 when the dryer 42 is pushed toward the wall with significantly reduced kinking, bending, or otherwise altering or damaging of the dryer hose 49.

It can also be seen that the dryer 42 can advantageously be placed in relatively close proximity to the wall 40. The practice of the present invention allows the distance 55 between the wall 40 and the dryer 42, represented by a, to be negligible.

Figure 6:
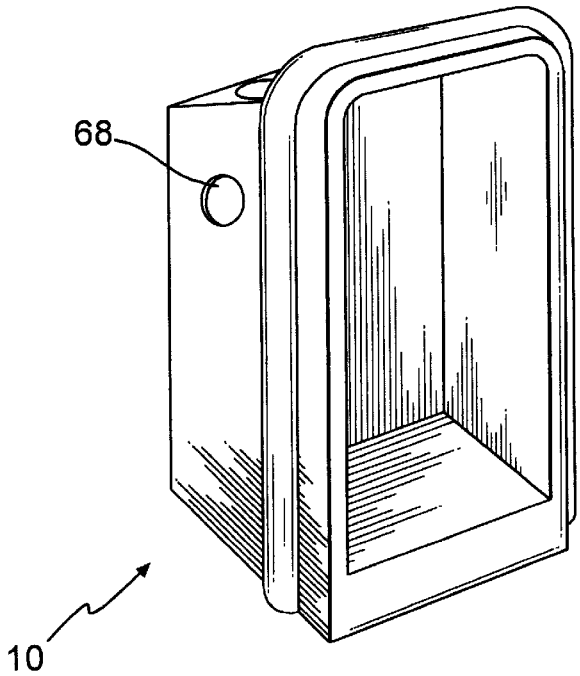
FIG. 6 is a perspective view of another embodiment of the invention which includes a port to receive a gas line.
Figure 7:
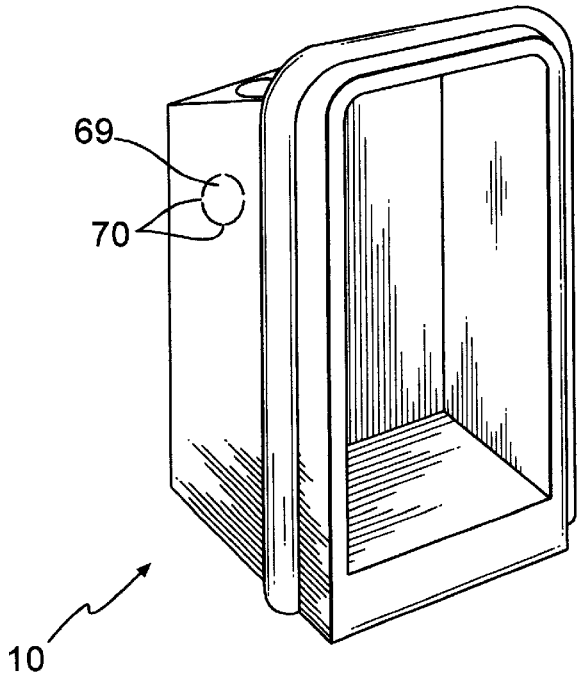
FIG. 7 is a perspective view of the embodiment of FIG. 4*a* in which the port is sealed with a knockout portion.
Figure 8C:
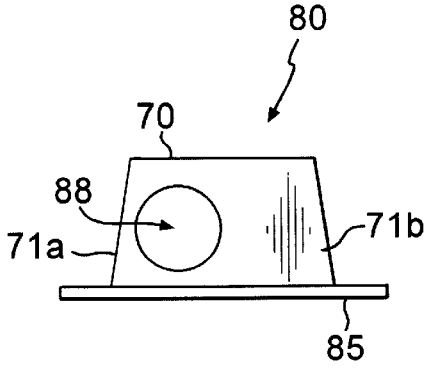
FIG. 8*c* is a top plan view of the embodiment shown in FIG. 8*a*.
Figure 8B:
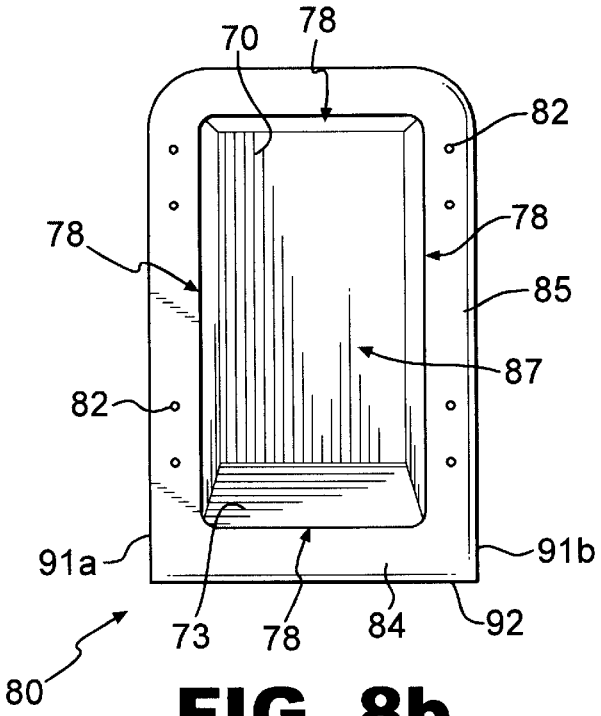
FIG. 8*b* is a front elevation view of the embodiment shown in FIG. 8*a*.
Figure 8D:
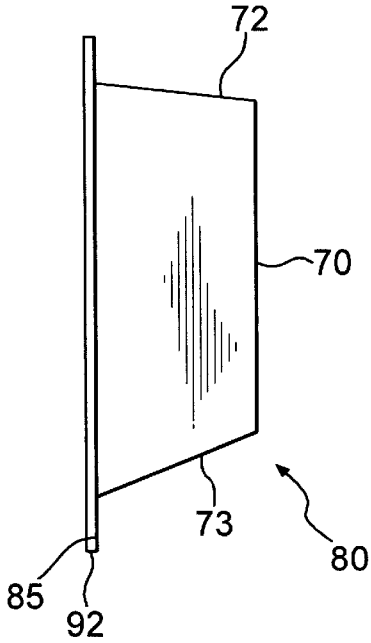
FIG. 8*d* is a side elevation view of the embodiment shown in FIG. 8*a*.

FIG. 6 illustrates additional features of the wall outlet box according to the present invention. In particular, the wall outlet box 10 can include an additional aperture 68 adapted to receive a gas line. As shown in FIG. 7, the aperture 68 can include a knockout portion 69 which preferably initially forms an impervious integral part of the enclosure, and can be attached to the enclosure by a plurality of frangible connector webs 70. The knockout portion 69 can be removed from the wall outlet box by rupturing the frangible connector webs 70 in order to provide the aperture 68 when the knockout portion 69 is removed.

As discussed above, the wall outlet box 10 is preferably installed into an unfinished stud wall during the construction process, and prior to the installation of the finished wall surface. In an alternative embodiment, the wall outlet box 10 can be configured for "retrofit" installation into a finished wall surface. This configuration can be accomplished by substantially reducing or eliminating the shoulder 26 that positions the mounting lip 25 in the plane defined by the front periphery 18, so that the mounting lip 25 extends outwardly from the forward facing edges of enclosure 17. The mounting lip 25 can then be secured to the exterior surface of a finished wall.

FIGS. 8*a*–8*d* illustrate a "retrofit" embodiment of the present invention. The wall outlet box 80 shown in FIGS.

8*a*–8*d* can include a back surface 70, a top surface 72, opposing side surfaces 71*a* and 71*b*, and an inclined lower surface 73 which form a pan-shaped enclosure 87, and an aperture 88 to receive an exhaust conduit. The front edges of the enclosure 87 are preferably located in a single plane and define a front periphery 78. These elements are preferably substantially identical in both construction and functionality to the corresponding elements for the embodiments discussed above, and can be substantially identical with regard to the previously discussed alternatives and variations therefor.

In order to permit installation into an existing, finished wall surface, the wall outlet 80 includes a planar mounting lip 85 which extends outwardly from the front periphery 78. The mounting lip 85 is preferably adjacent with and contiguous to front periphery 78, and is preferably co-planar with the plane defined by front periphery 78. The lower portion of mounting lip 85 forms base rim portion 84. The mounting lip 85 can include mounting structures, such as holes 82 which are adapted to receive mounting screws, to secure the box 80 to a wall surface. The mounting lip 85 is preferably secured to at least one underlying stud within the finished wall.

The mounting lip 85 can have any suitable geometric shape, and is preferably substantially rectangular. The lower edge of the base rim portion 84 is preferably linear to allow flush alignment with the floor surface. The bottom edge 92 and opposing side edges 91*a*, 91*b* of the mounting lip 25 preferably intersect at right angles to allow for ease of installation, and to permit close engagement with the baseboard and floor.

Figure 9:
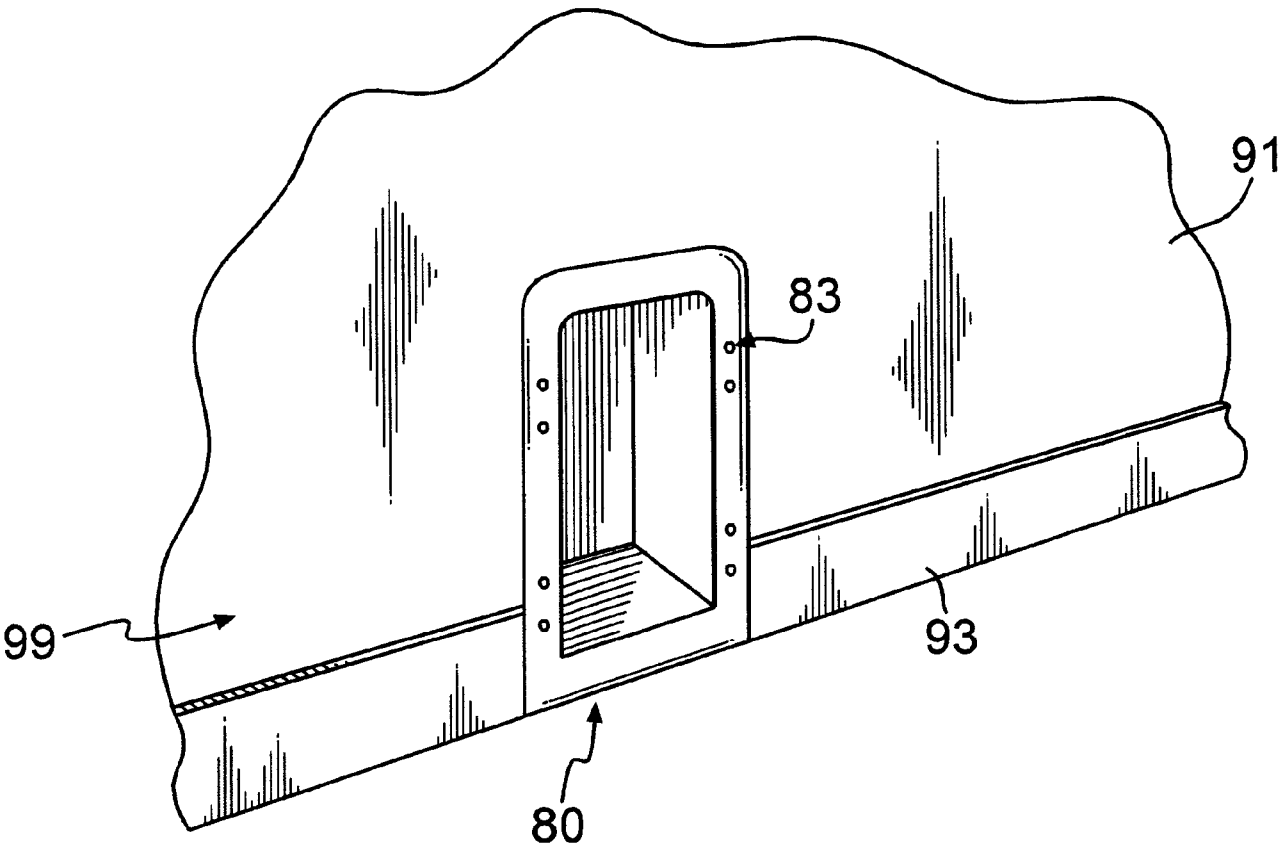
FIG. 9 is a perspective view of the embodiment shown in FIG. 8*a* installed in a finished wall.

FIG. 9 illustrates the wall outlet box 80 installed into a finished wall 99. As illustrated, a rough opening (not visible in the illustration) can be cut into the wall surface 91 proximate to the location of the exhaust conduit, to allow insertion of the wall outlet box 80 into a wall cavity. The opening in the wall surface 91 is preferably sized to permit insertion of the enclosure 87 into the wall cavity, while still allowing the mounting lip 85 to be positioned on the exterior surface of the wall surface 91. It will be noted that a portion of the baseboard 93 can be removed during installation of the wall outlet box 80. The resulting gap in the baseboard 93 is preferably sized for close engagement with the side edges of the mounting lip 85. During installation, the wall outlet box 80 can be positioned such that the mounting lip 85 is located on or proximate to the exterior surface of the wall surface 91 and the enclosure 87 extends into the wall cavity. The aperture 88 is preferably aligned with or connected to the dryer exhaust conduit (not shown). The box 10 can be secured to the wall 99 by mounting screws 83 which are inserted into holes 82, and which preferably extend through the wall surface 91 and into underlying studs or the bottom plate of wall 99.

The present invention can be constructed from a variety of materials, and for safety considerations is preferably constructed of materials which are substantially fire resistant and have non-flammable and non-meltable properties. Suitable materials include metal, fiberglass, ceramic materials, and plastics having the appropriate properties, although other materials are also acceptable. The present invention can be formed as an integral piece using conventional injection molding techniques known in the art, although the invention is not limited in that regard. For example, the present invention can also be constructed from flat stock sheet metal using sheet metal tools.

The invention is capable of taking a number of specific forms without departing from the spirit or essential attributes thereof. Accordingly, the following claims should be referenced to determine the scope of the invention, rather than the foregoing specification.

What is claimed is:

1. A wall outlet box, comprising:

a plurality of substantially planar integral walls defining an enclosure open at the front thereof, said enclosure including a back surface, a pair of opposing side surfaces, a top surface, and a bottom surface;

wherein said opposing side surfaces, bottom surface and top surface have forward facing edges;

wherein said forward facing edges are substantially aligned in a single plane and collectively define a front periphery;

wherein said bottom surface extends downwardly from said back surface to said front periphery at an angle of up to approximately 60° with respect to a plane defined by said back surface;

mounting lip extending outwardly from said forward facing edges, said mounting lip including mounting structures; and at least one port in at least one of said opposing side surfaces, back surface and top surface adapted to engage with a dryer exhaust conduit, whereby a flexible hose can be inserted into the exhaust conduit, said bottom surface being configured to guide the flexible hose toward the exhaust conduit, and at least a portion of the flexible hose can be housed in said enclosure.

2. The wall outlet box of claim 1, wherein said mounting structure comprises holes in said mounting lip adjacent to said opposing side surfaces.

3. The wall outlet box of claim 1, wherein said at least one port comprises an aperture in at least one of said opposing side surfaces, back surface and top surfaces.

4. The wall outlet box of claim 1, wherein said mounting lip is configured to allow said wall outlet box to be mounted to at least one vertical wall stud in a stud wall.

5. The wall outlet box of claim 1, wherein said top surface and said opposing side surfaces flare outwardly from said back surface to said front periphery.

6. The wall outlet box of claim 1, wherein said wall outlet box further includes a shoulder extending generally outwardly from said front periphery, said shoulder having a depth at least as large as the depth of a wall surface, whereby said wall outlet box can be installed in an unfinished stud wall prior to the installation of a wall surface on the stud wall and said shoulder abuts the inner edges of said wall surface after said wall outlet box is installed.

7. The wall outlet box of claim 6, wherein said shoulder is adjacent and contiguous to said forward facing edges of said top and opposing side surfaces.

8. The wall outlet box of claim 7, further comprising a front base rim portion, said front base rim portion being adjacent and contiguous to said forward facing edge of said bottom surface and extending downwardly from said bottom surface.

9. The wall outlet box of claim 8, wherein said bottom surface is adapted for placement on a bottom plate secured to a floor surface, and said front base rim portion has a height approximately equal to the height of the base plate, whereby said front base rim portion extends downwardly from said bottom surface to be in alignment with the floor surface after said wall outlet box is mounted on the stud wall.

10. The wall outlet box of claim 1, wherein said enclosure further includes at least one port adapted to receive a gas line.

11. The wall outlet box of claim 1, wherein said enclosure includes a knockout portion initially forming an impervious integral part of the enclosure, said knockout portion having at least one frangible connection to said enclosure located and sized to create a port when said knockout portion is removed.

12. A wall outlet box, comprising:

a plurality of substantially planar integral walls defining an enclosure open at the front thereof, said enclosure including a back surface, a pair of opposing side surfaces, a top surface, and a bottom surface, said opposing side surface, bottom surface and top surface having forward facing edges, said forward facing edges being aligned in a single plane and collectively defining a front periphery; said bottom surface extending downwardly from said back surface to said front periphery at an angle of up to approximately 60° with respect to a plane defined by said back surface;

a generally L-shaped mounting lip integrally formed with said front periphery; said mounting lip being adjacent to said forward facing edges of said opposing side surfaces and said top surface, said mounting lip having a first section and a second section, said first section being generally perpendicular to said front periphery and extending rearwardly therefrom, said second section further including mounting structures adapted to secure said second section to at least one vertical stud of a stud wall, said first section having a width at least as large as a wall surface to be installed on the stud wall, whereby said first section can be secured to a stud wall, and the finished wall surface mounted on said stud wall is shouldered by said second section; and at least one port in at least one of said opposing side surfaces, back surface and top surface adapted to engage with a dryer exhaust conduit, whereby a flexible hose can be inserted into the exhaust conduit, said bottom surface being configured to guide the flexible hose toward the exhaust conduit, and at least a portion of the flexible hose can be housed in said enclosure.

13. The wall outlet box of claim 12, wherein said mounting structure comprises holes in said mounting lip adjacent to said opposing side surfaces adapted to receive mounting screws.

14. The wall outlet box of claim 12, wherein said aperture is in said top surface.

15. The wall outlet box of claim 12, wherein said top surface and opposing side surfaces flare outwardly from said back surface to said front periphery.

16. The wall outlet box of claim 12, further including a front base rim portion, said front base rim portion being adjacent and contiguous to said forward facing edge of said bottom surface, said front base rim portion extending downwardly from said bottom surface.

17. The wall outlet box of claim 12, wherein said bottom surface is adapted for placement on a bottom plate secured to a floor surface, and said front base rim portion has a height approximately equal to the height of the base plate, whereby said front base rim portion extends downwardly from said bottom surface to be in alignment with the floor surface after said wall outlet box is mounted on the stud wall.

18. The wall outlet box of claim 12, wherein said enclosure further includes a port to receive a gas line.

19. The wall outlet box of claim 12, wherein said enclosure includes a knockout portion initially forming an impervious integral part of the enclosure, said knockout portion having at least one frangible connection to said enclosure located and sized to create a port when said knockout portion is removed.

20. A wall outlet box, comprising:

a plurality of substantially planar integral walls defining an enclosure open at the front thereof, said enclosure including a back surface, a pair of opposing side surfaces, a top surface and a bottom surface;

wherein said opposing side surfaces, bottom surface and top surface have forward facing edges;

wherein said forward facing edges are substantially aligned in a single plane and collectively define a front periphery;

wherein said bottom surface extends downwardly from said back surface to said front periphery at an angle of up to approximately 60° with respect to a plane defined by said back surface;

at least one port in at least one of said opposing side surfaces, back surface and top surface adapted to engage with an exhaust conduit, said bottom surface being configured to guide the flexible hose toward the exhaust conduit; and a substantially planar mounting lip contiguous to said forward facing edges extending outwardly in the plane defined by said front periphery, said mounting lip including mounting structures.

21. The wall outlet box of claim 20, wherein said mounting lip is adapted for placement on the exterior surface of a finished wall.

22. The wall outlet box of claim 20, wherein said mounting lip has a top edge, a pair of opposing side edges, and a bottom edge, and said pair of opposing side edges orthogonally intersects said bottom edge.

* * * * *